US006508538B2

(12) United States Patent
Suzuki et al.

(10) Patent No.: US 6,508,538 B2
(45) Date of Patent: Jan. 21, 2003

(54) LIQUID EJECTION HEAD, HEAD CARTRIDGE AND EJECTION APPARATUS WITH PLURAL, INDEPENDENT LIQUID SUPPLY MEANS

(75) Inventors: Toru Suzuki, Kanagawa (JP); Junji Shimoda, Kanagawa (JP); Akira Tsujimoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/965,835

(22) Filed: Oct. 1, 2001

(65) Prior Publication Data

US 2002/0044178 A1 Apr. 18, 2002

(30) Foreign Application Priority Data

Oct. 2, 2000 (JP) ..... 2000-302721

(51) Int. Cl.[7] ..... B41J 2/01; B41J 2/05
(52) U.S. Cl. ..... 347/43; 347/65
(58) Field of Search ..... 347/43, 65–67, 347/42, 84–86, 15

(56) References Cited

U.S. PATENT DOCUMENTS 5,635,966 A * 6/1997 Keefe et al. ..... 347/43
6,234,622 B1 5/2001 Liu et al. ..... 347/93

FOREIGN PATENT DOCUMENTS

JP 10-305592 11/1998 ..... B41J/2/175
JP 2000-302721 10/2000 ..... C07C/46/00

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

Under the condition that common ink flow passages are formed for separately supplying inks to respective ejection opening arrays of an orifice plate, flow passage cross sectional areas of branched ink flow passages are set respectively according to ejection amounts of the respective ejection opening arrays.

15 Claims, 13 Drawing Sheets

LIQUID EJECTION HEAD, HEAD CARTRIDGE AND EJECTION APPARATUS WITH PLURAL, INDEPENDENT LIQUID SUPPLY MEANS

This application is based on Patent Application No. 2000-302721 filed Oct. 2, 2000 in Japan, the content of which is incorporated hereinto by reference.

BACKGROUND OF THE INVENTION

1. Field of the Invention

The present invention relates to a liquid ejection head for ejecting a liquid, a head cartridge provided with the same, and a liquid ejection apparatus.

2. Description of the Related Art

An ink-jet printing apparatus is equipped with an ink-jet print-head as a liquid ejection print head. As the ink-jet print head, there is generally known an edge shooter type or a side shooter type ink-jet print head.

The side shooter type ink-jet print head, for example, as shown in Japanese Patent Laid-open Publication No. 8446/1994, or FIG. 11 and FIG. 12, comprises a tank 8 storing a predetermined ink, and an orifice plate 2 having a plurality of ink ejection openings 2*a*i and 2*b*i (i=1 to n, n being an integer) for ejecting ink from the tank 8, a printing element substrate 4 joined with the orifice plate 2 and having heaters (heat generation resistors) 4*a*i and 4*b*i (i=1 to n, n being an integer) as printing elements opposing the respective ink ejection openings 2*a*i and 2*b*i, and a connection member 6 for connecting the orifice plate 2 and the printing element substrate 4 and the tank 8.

Such an ink jet print head is, for example, connectedly disposed with a predetermined height difference relative to an ink supplier for supplying ink to its tank 8, so that its internal pressure is a predetermined negative pressure.

The tank 8, as shown in FIG. 12, has an opening 8*a* for communicating the storage for storing ink 12 with a communicating passage 6*a* of the connection member 6. The communicating passage 6*a* of the connection member 6 communicates with a common liquid chamber 2*e* in the orifice plate 2 through an ink supply opening 4*d* at a nearly central part of the printing element substrate 4. Therefore, a supply passage 10 is formed of the opening 8*a*, communicating passage 6*a* and the ink supply opening 4*d*. With this construction, ink 12 in the tank 8 is supplied to the common liquid chamber 2*e* through the supply passage 10 along the direction shown by the arrow.

The ink supplied to the common liquid chamber 2*e* is supplied to each branched supply passage formed between the orifice plate 2 and the printing element substrate 4. At the part opposing the ink ejection openings 2*a*i and 2*b*i in the respective branched supply passages, heaters 4*a*i and 4*b*i are formed, respectively.

The respective heaters 4*a*i and 4*b*i are controlled by drive pulse signals according to an image data representing an image to be printed from a controller (not shown). By this operation, when the respective heaters 4*a*i and 4*b*i are operative, the ink 12 is heated by the respective heaters 4*a*i and 4*b*i to be ink droplets ID by a film boiling phenomenon which are ejected to a recording surface of the printing medium.

Further, in the ink-jet print head, instead of the operation that the ink 12 is supplied to each of the respective branched supply passages of the printing element substrate 4 through the ink supply opening 4*d* at its nearly central part as described above, for example, as shown in Japanese Patent Laid-open Publication No. 305592/1998 and FIG. 13, it is proposed that ink is supplied from both end sides of the printing element substrate to each branched supply passage.

Referring to FIG. 13, the ink-jet print head comprises a tank 14 for storing ink 22, a substrate support member 20 disposed in the tank 14 for supporting the printing element substrate 18, and an orifice plate 16 having a plurality of ejection openings 16*a*i and 16*b*i (i=1 to n, n being an integer) opposing the respective heater 18*a*i and 18*b*i of the printing element substrate 18 and joined to the tank 14.

Between the heaters 18*a*i and 18*b*i of the printing element substrate 18 and the inside surface of surface on which the ejection openings 16*a*i and 16*b*i of the orifice plate 16 are formed, branched supply passages are formed which conduct the ink 22 from both end sides of the printing element substrate 18 to the respective heaters 18*a*i and 18*b*i. With this construction, similar to as described above, when the respective heaters 18*a*i and 18*b*i are operative, the ink 22 is ejected in the form of ink droplets ID through the ejection openings 16*a*i and 16*b*i.

When inks of a plurality of colors are ejected using a print head as shown in FIG. 11, the inside of the above tank 8 is partitioned to store inks of respective colors, for example, Yellow Y, Magenta M, and Cyan C, further, in the ink ejection openings 2*a*i and 2*b*i in the orifice plate 2 and in the heaters 4*a*i and 4*b*i of the printing element substrate 4, areas 2Y, 2M and 2C are previously set which are used according to Yellow Y, Magenta M, and Cyan C.

In such a case, when the print head is moved along the direction shown by arrow S shown in FIG. 11 to perform printing operation with inks of respective colors, since the printing width along the arrangement direction of the ejection openings printed per one movement is decreased as compared to a case of ejecting ink of a single color, resulting in a reduction of a so-called throughput.

In such a case, for example, to prevent the reduction of the throughput, it is considered that three orifice plates 2 and printing element substrates 4 are provided in parallel. However, as a result thereof the print head is increased in size against the requirement of downsizing.

Further, when inks of a plurality of different colors are used in the constructions of the orifice plate and printing element substrate as shown FIG. 12 and FIG. 13, it is difficult in design to set flow rates flowing in the respective ejection opening arrays according to ejection amounts of respective inks.

SUMMARY OF THE INVENTION

In view of the above problems, it is an object of the present invention to provide a liquid ejection head for ejecting a liquid, a head cartridge provided therewith and a liquid ejection apparatus which are capable of setting respective flow rates of inks flowing in respective ejection opening arrays according to ejection amounts of respective inks without reducing a so-called throughput.

In accordance with the present invention which attains the above object, there is provided a liquid ejection head comprising a liquid ejection opening formation section in which a first group of liquid ejection openings and a second group of liquid ejection openings for ejecting a liquid are formed, an element substrate having a plurality of energy generation elements formed in opposition to the first group of liquid ejection openings and the second group of liquid ejection openings for generating energy utilized to eject a liquid from the first group of liquid ejection openings and the second group of liquid ejection openings, a first liquid supply passage formed between one end of the element substrate and an inner wall of the liquid ejection opening formation section for supplying a liquid stored in a first liquid supply source onto the energy generation element opposing the first group of liquid ejection openings, and a second liquid supply passage formed independently of the first liquid supply passage between the other end at the opposite side to one end of the element substrate and an inner wall of the liquid ejection opening formation section for supplying a liquid stored in a second liquid supply source independent of the first liquid supply source onto the energy generation element opposing the second group of liquid ejection openings.

Further, the liquid ejection head according to the present invention comprises a liquid ejection opening formation section in which a first group of liquid ejection openings and a second group of liquid ejection openings for ejecting a liquid are formed, a printing element substrate having printing elements formed in opposition to the first group of liquid ejection openings and the second group of liquid ejection openings of the liquid ejection opening formation section for ejecting a liquid through the first group of liquid ejection openings and the second group of liquid ejection openings, a liquid supply passage formed inside the printing element substrate for supplying the liquid from a liquid supply source to a printing element opposing the first group of liquid ejection openings in the printing element substrate, and a liquid supply passage group comprising a plurality of liquid supply passages formed inside the printing element substrate independent of the first liquid supply passage for individually supplying liquids from a plurality of liquid supply sources to printing elements opposing the second group of liquid ejection openings in the printing element substrate.

The liquid ejection apparatus according to the present invention comprises the above liquid ejection head, moving means for moving the liquid ejection head in opposition to a recording surface of the printing medium, and a controller for controlling the printing operation of the liquid ejection head and operation of the moving means.

As can be seen from the above description, according to the liquid ejection head of the present invention, and the head cartridge provided with the same, and the liquid ejection. apparatus, since the flow passage cross sectional area of the first liquid supply passage and the flow passage cross sectional area of the second liquid supply passage are set according to ejection amounts respectively of the first liquid ejection opening array and the second liquid ejection opening array, flow rates flowing in the respective ejection opening arrays can be set without reducing a so-called throughput and according to respective ink ejection amounts.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 3:
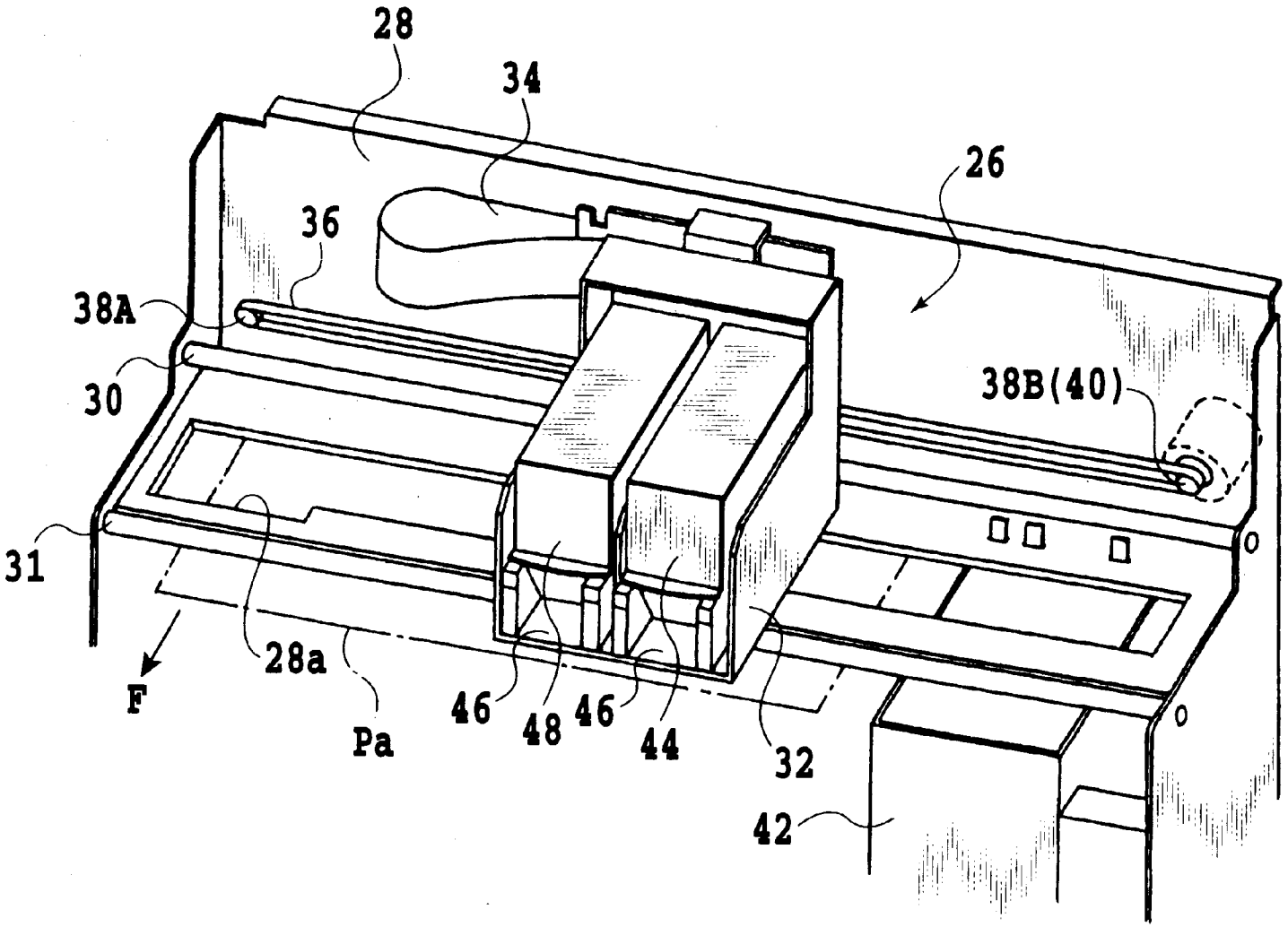
FIG. 3 is a perspective view showing an essential part of the printing apparatus to which the embodiment of the liquid ejection head according to the present invention is applied.

FIG. 3 shows an essential part of the ink-jet printing apparatus to which an example of liquid ejection head according to the present invention is applied.

The ink-jet printing apparatus shown in FIG. 3 comprises a carriage member 32 respectively supporting two detachably mounted ink tank holders 46, a guide shaft 30 supported at both ends of an enclosure 28 for reciprocal movably supporting the bottom of the carriage member 32, a guide shaft 31 supported at both ends of the enclosure 28 nearly in parallel to the guide shaft 30 for reciprocal movably supporting the bottom of the carriage member 32, a motor 40 for transmitting a drive force to a belt 36 connected to the carriage member 32 through a pulley 38B, and a recovery processing apparatus 42 disposed at one end of the inside of the enclosure 28 for performing recovery processing to an ink ejection section which will be described later.

The belt 36 is wound on pulleys 38A and 38B rotatably supported on the back surface portion of the enclosure 28 at a predetermined interval. The pulley 38B is connected to an output shaft of the motor 40. The motor 40 is controlled by a drive control signal from a controller (not shown) so that the output shaft thereof is rotated in the forward or reverse direction. By this operation, the carriage member 32 is reciprocally moved in a range of predetermined distance from a position immediately above the recovery processing apparatus 42 while being guided by the guide shafts 30 and 31 at a predetermined timing together with the two ink tank holders 46 and ink tanks 44 and 48 which will be described later.

A connector section of the carriage member 32 is electrically connected with an end of a flexible cable 34 for supplying a drive control signal group to a print head unit which will be described later.

Further, at a lateral part of the recovery processing apparatus 42 at the inside of the enclosure 28, a paper transportation passage for transporting a printing paper Pa as a printing medium intermittently in the direction shown in arrow F in FIG. 3 is provided beneath the carriage member 32.

Each ink tank holder 46 formed of a resin has a tank container for detachably containing the ink tank 44 or ink tank 48.

The ink tank 44 and the ink tank 48 are junctioned respectively to an ink ejection section of the print head unit which will be described later.

Since the ink tank 44 and the ink tank 48 have the same structure except for the type of stored ink, the ink tank 44 will be described and description of the ink tank 48 is omitted.

The ink tank 44 is to store each of yellow ink and magenta ink, and the ink tank 48 is to store each of cyan ink and black ink.

Figure 2:
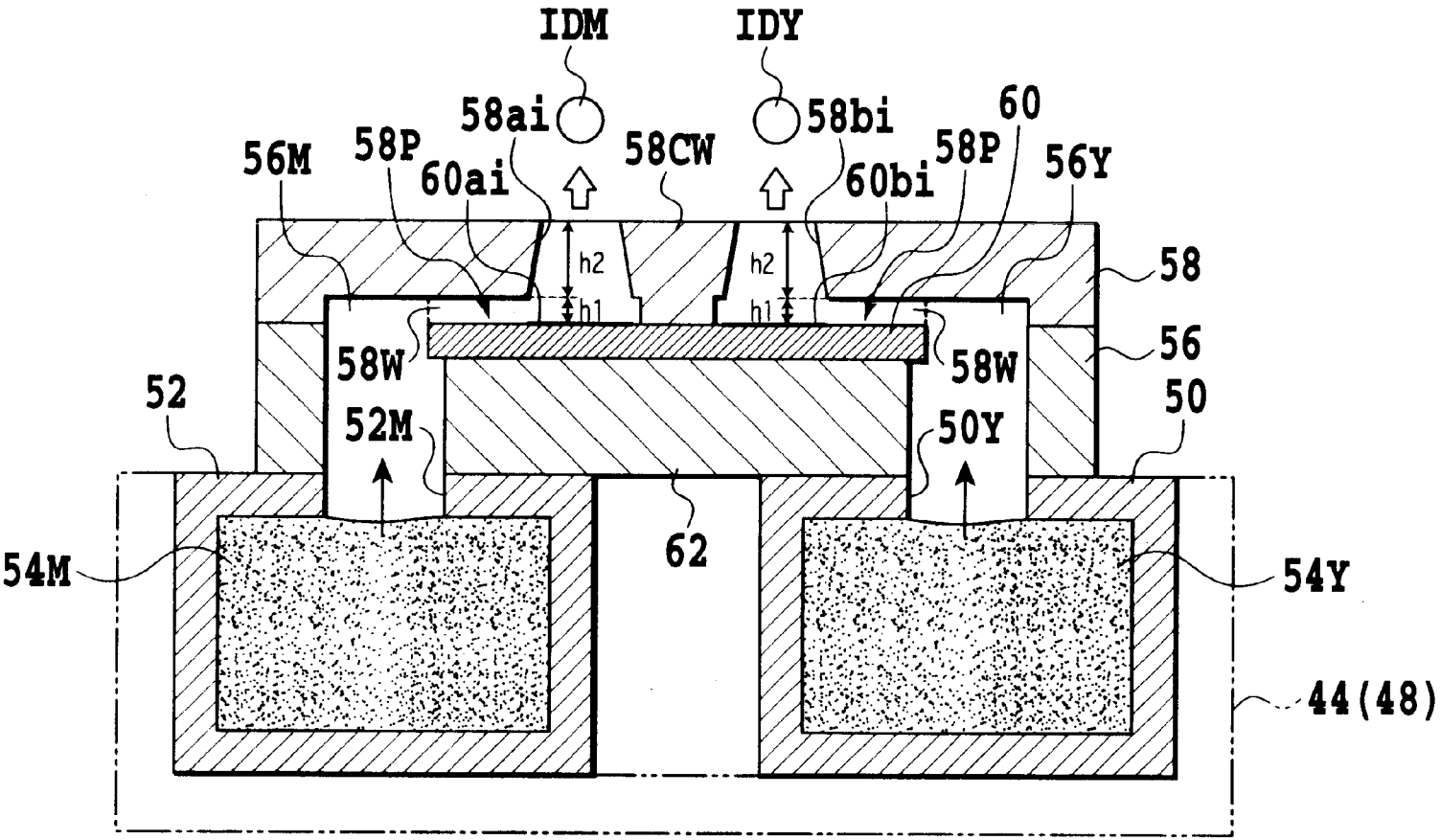
FIG. 2 is a cross sectional view in the example shown in FIG. 1.

Inside the ink tank 44, as shown in FIG. 2, a tank section 50 having an ink absorbing body 54Y impregnated with yellow ink and a tank section 52 having an ink absorbing body 54M impregnated with magenta-ink are provided.

As the ink absorbing bodies 54Y and 54M, for example, a polyurethane foam is preferably used. Further, as shown in FIG. 2, ink supply openings 50Y and 52M communicating with the inside are formed corresponding to common ink flow passages 56Y and 56M which will be described later.

The tank section 50 and the tank section 52 are bonded with one end side of a connection member 56 forming part of the construction of the print head unit. At the other end side of the connection member 56, an orifice plate 58 as a liquid ejection opening formation section is bonded.

Figure 1:
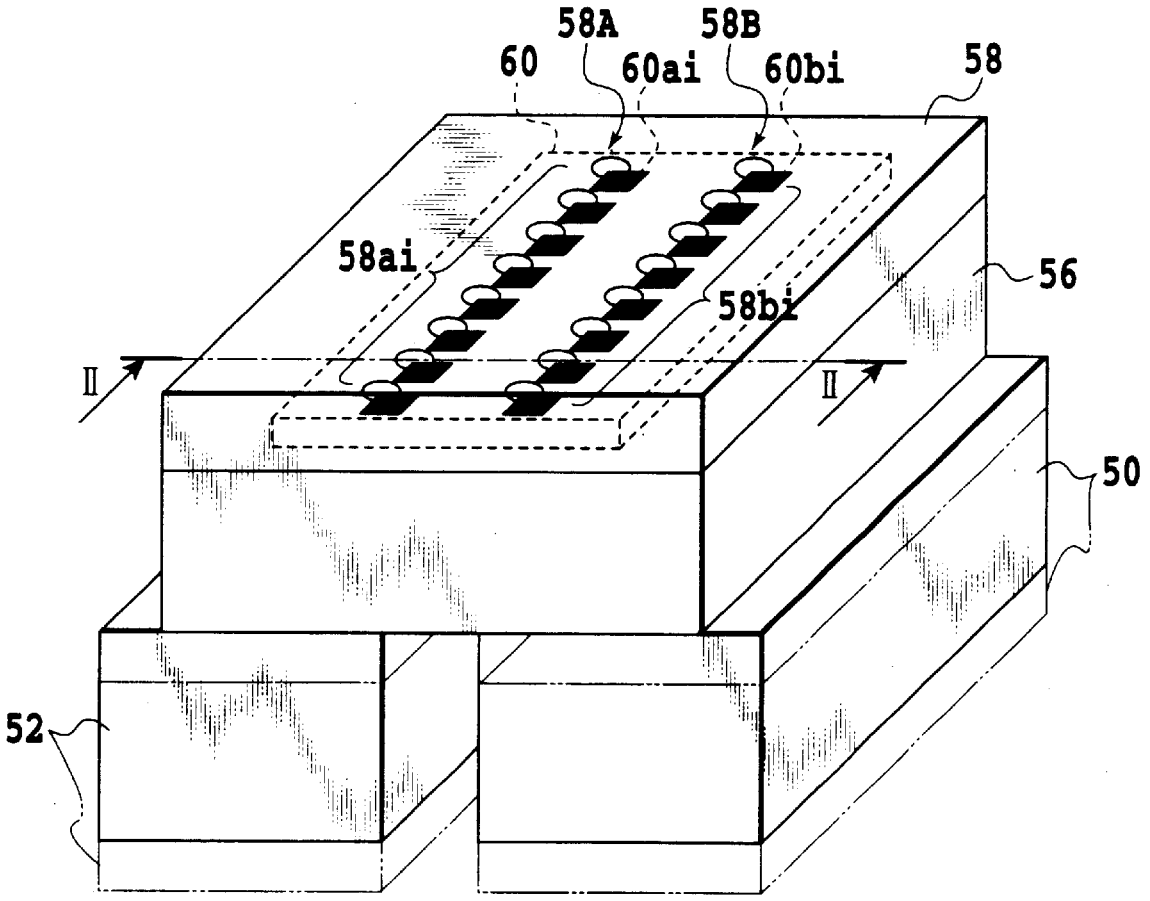
FIG. 1 is a perspective view showing an essential part of a first embodiment of the liquid ejection head according to the present invention.

Not limited to this example, the tank 50 and the tank 52, as shown by the chain doubled-dashed line in FIG. 1, for supplying ink, may be of a construction in which the tanks are detachably mounted to the connection member 56 and a base 62. That is, the tank 50 and the tank 52 may be, for example, mounted with screws to the connection member 56 and the base 62 through a predetermined sealing member.

The orifice plate 58, as shown in FIG. 1 and FIG. 2, has two rows of ejection opening arrays 58A and 58B in parallel to each other at the flat portion. The ejection opening arrays 58A and 58B are provided with a plurality of ejection openings 58*a*i and 58*b*i (i=1 to n, n being an integer) formed in opposition to each other at a predetermined interval.

Between the each other opposing ejection opening arrays 58A and 58B, is partitioned by a central wall 58CW protruding inside the orifice plate 58 and extending to both ends along the arrangement direction of the ejection openings. Further, between respective adjacent ejection openings 58*a*i and respective ejection openings 58*b*i are partitioned by a partition wall 58w formed on the internal surface of the orifice plate 58.

The orifice plate 58 may be formed of, for example, resin materials such aspolysulfone, Aramika (trademark), Upilex (trade mark) or the like. For example, when the orifice plate is made of an Aramika film with a film thickness of 50 (μm), in the orifice plate 58, ejection openings thereof and the like may be machined by way of an excimer laser (KrF, ArF, XeCl or the like), a YAG laser or the like.

Further, at the tip of the central wall 58CW, a nearly central part of one flat surface of the printing element substrate 60 is bonded. Both ends of shorter side of the printing element substrate 60 are junctioned to the inner surface of the connection member 56. With this construction, a plurality of branched ink flow passages 58*p* are formed corresponding to the respective ejection openings 58*a*i and 58*b*i between one flat surface of the printing element substrate 60 and the inner surface of the orifice plate 58. The plurality of branched ink flow passages 58*p* are communicated with common ink flow passages 56Y and 56M formed respectively at longer side both ends of the printing element substrate 60.

Therefore, a first liquid supply passage is formed by the branched ink flow passage 58*p* and the common ink flow passage 56Y, and a second liquid supply passage is formed by the branched ink flow passage 58*p* and the common ink flow passage 56M.

In FIG. 2, a distance h1 between one flat surface of the printing element substrate 60 and the inner surface of the orifice plate 58 is set according to predetermined ejection amount of each ink, for example, set to about 12 (μm). A thickness h2 of the orifice plate 58, that is, a depth h2 of the respective ejection openings 58*a*i and 58*b*i is set to, for example, about 13 (μm). The distance h1 and h2 corresponding to the respective ejection opening arrays 58A and 58B are set to the same.

On one flat surface of the printing element substrate 60, a plurality of heaters 60*a*i and 60*b*i (i=1 to n, n being an integer) as electrothermal converters as printing elements opposing the respective ejection openings 58*a*i and 58*b*i are formed in the respective branched ink flow passages 58*p*. The printing element substrate 60 is bonded on the base 62 which is bonded extending over the tanks 50 and 52.

Both ends in the perpendicular direction to the paper surface in the base 62 are bonded to the inner surface of the connection member 56, respectively. The plurality of heaters 60*a*i and 60*b*i are controlled according to drive control pulse signals corresponding to image data representing an image to be printed from the controller (not shown). Therefore, the ink ejection portion of the print head unit is formed by the connection member 56, the orifice plate 58, the printing element substrate 60 and the base 62.

In assembling such an ink ejection portion, the plurality of heaters 60*a*i and 60*b*i are positioned with the respective ejection openings 58*a*i and 58*b*i and then the above formed orifice plate 58 is bonded to the printing element substrate 60 and the base 62.

Next, by bonding the connection member 56 to one end surface of the orifice plate 58, the common ink flow passages 56Y and 56M are formed.

Next, by performing electrical wiring between respective heaters 60*a*i and 60*b*i of the printing element substrate 60 and the signal input/output section (not shown), the ink ejection opening section is completed.

In such a construction, the ink ejection section, as shown in FIG. 2, when the paper Pa is in a stop state, in association with movement of the carriage member 32, each ink droplet IDY of yellow and droplet IDM of magenta are ejected at a predetermined timing to the recording surface of the paper Pa to perform printing operation through the opening 28*a* of the enclosure 28.

Therefore, even when inks of a plurality of ink colors are ejected by a single ink ejection section, similar to the case of ink ejection section for ejecting only a single color ink, the printing width of the ink ejection section per scan of the carriage member 32 can be maintained. Further, it is possible to eject inks of a plurality of ink colors with a high precision proximity to each other of the ejection opening arrays 58A and 58B. Still further, for example, even in the case of ejecting inks of four colors differing from each other, the required number of printing element substrates 60 is smaller than the prior art method, that is, two substrates will be sufficient. Yet further, since the common ink flow passages 56Y and 56M are formed at both ends by the longer side of the printing element substrate 60, respectively, the cross sectional area of supply flow passage can be easily increased without relatively increasing the size of the printing element substrate 60. As a result thereof, flexibility of changing the ink flow rate of each ink in designing is improved.

Figure 4:
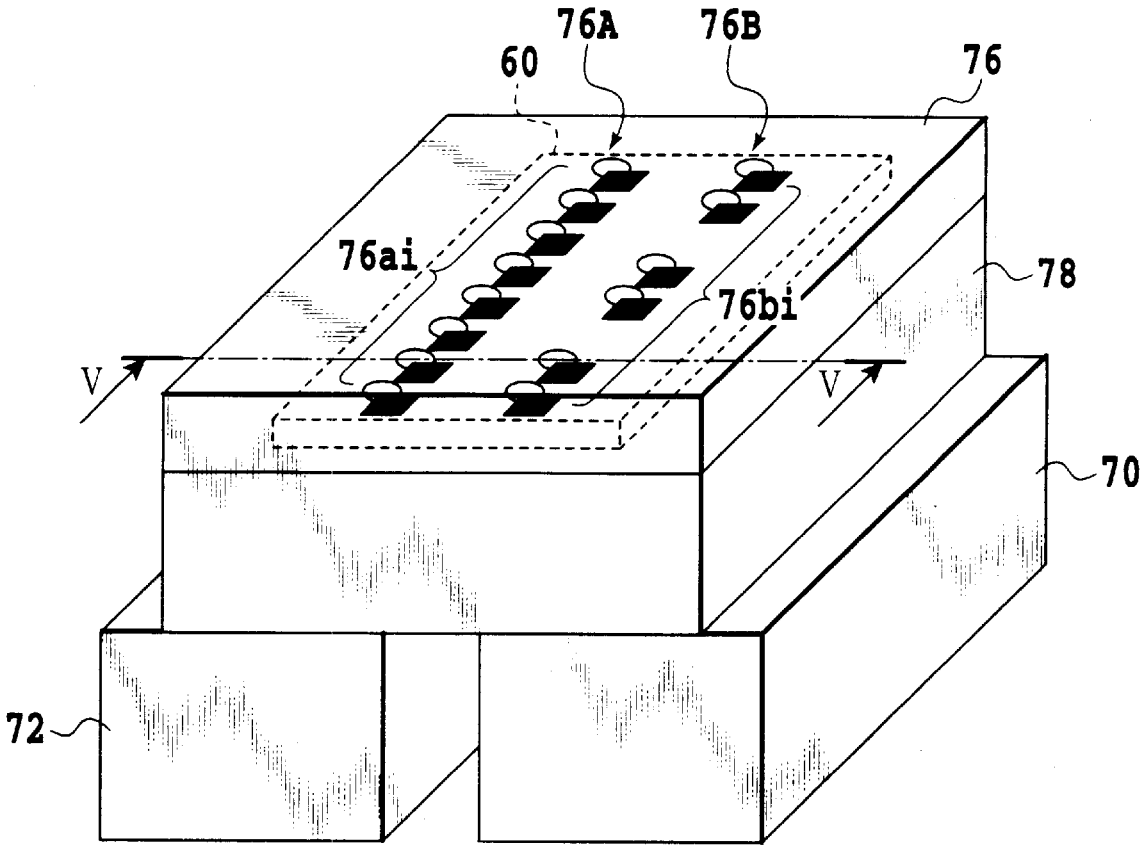
FIG. 4 is a perspective view showing an essential part of a second embodiment of the liquid ejection head according to the present invention.
Figure 5:
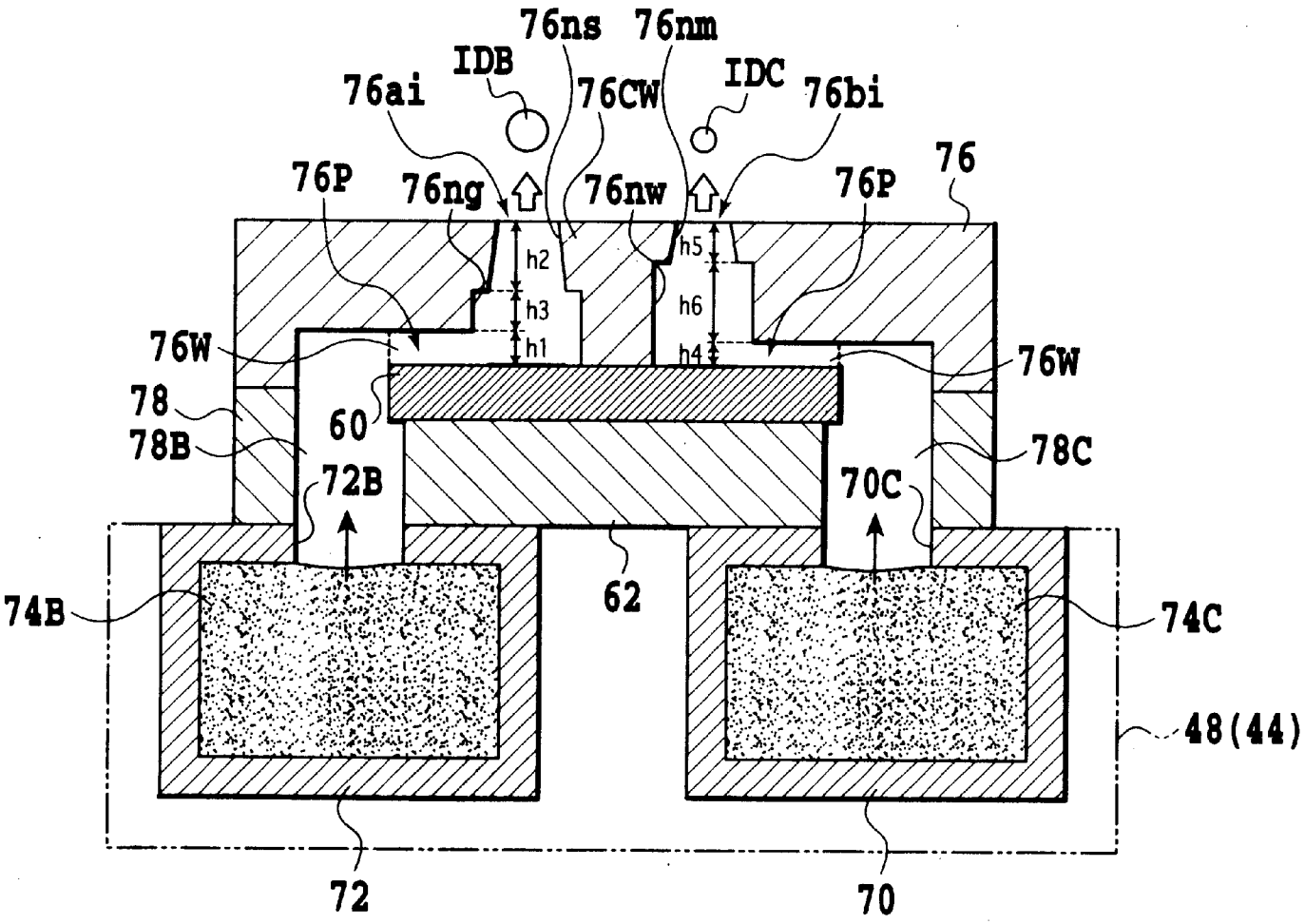
FIG. 5 is a cross sectional view in the example shown in FIG. 4.

FIGS. 4 and 5 show essential part of a second embodiment of the liquid ejection print head according to the present invention. The same components as shown in FIGS. 1 and 2 are indicated by the. same reference symbols, and detailed description thereof is omitted.

In the example shown in FIG. 2, the distance h1 corresponding to the respective ejection opening arrays 58A and 58B is the same as each other, the cross sectional shapes of the ejection openings are same as each other. However, in the example shown in FIGS. 4 and 5, the distances h1 and h4 corresponding to respective ejection opening arrays 76A and 76B are different from each other, and the cross sectional shapes of the ejection openings are different from each other.

Inside the ink tank 48, as shown in FIG. 5, a tank 70 having an ink absorbing body 74C impregnated with cyan ink, and a tank 72 having an ink absorbing body 74B impregnated with black ink are provided.

As the ink absorbing bodies 74C and 74B, for example, a polyurethane foam is preferably used. Further, inside the tanks 70 and 72, as shown in FIG. 5, ink supply openings 70C and 72B communicating with the inside are formed correspondingly to the common ink flow passages 78C and 78B which will be described later.

To the tanks 70 and 72, one end side of the connection member 78 as part of construction in the print head unit is bonded. To the other end side of the connection member 78, the orifice plate 76 is bonded.

The orifice plate 76, as shown in FIG. 4 and FIG. 5, has two rows of ejection opening arrays 76A and 76B in parallel to each other at the flat portion. The ejection opening arrays 76A and 76B are provided with a plurality of ejection openings 76*a*i and 76*b*i (i=1 to n, n being an integer) formed in opposition to each other at a predetermined interval. Further, in this example, the ejection openings 76*a*i and 76*b*i are different in shape and size, and the number of ejection openings of the ejection opening array 76A is greater than the number of ejection openings of the ejection opening array 76B.

The each other opposing ejection opening arrays 76A and 76B, are partitioned by a central wall 76CW protruding inside the orifice plate 76 and extending to both ends along the arrangement direction of the ejection openings. Further, between respective adjacent ejection openings 76*a*i and between respective ejection openings 76*b*i are partitioned by a partition wall 76*w* formed on the internal surface of the orifice plate 76.

Further, at the tip of the central wall 76CW, a central part of one flat surface of the printing element substrate 60 is bonded. Both ends by shorter side of the printing element substrate 60 are junctioned to the inner surface of the connection member 78, respectively. With this construction, a plurality of branched ink flow passages 76*p* are formed corresponding to nearly circular respective ejection openings 76*a*i and 76*b*i between one flat surface of the printing element substrate 60 and the inner surface of the orifice plate 76. The plurality of branched ink flow passages 76*p* are communicated with common ink flow passages 78C and 78B formed respectively at both ends by longer side of the printing element substrate 60.

In FIG. 5, a distance h1 between one flat surface of the printing element substrate 60 and the inner surface of the part on which the ejection opening array 76A of the orifice plate 76 is formed, is set according to predetermined ejection amount (30 ng) of black ink per one ejection opening, for example, set to about 25 (μm). On the other hand, a distance h4 between one flat surface of the printing element substrate 60 and the inner surface of the part on which the ejection opening array 76B of the orifice plate 76 is formed, is set according to a predetermined ejection amount (4.5 ng) of cyan ink per on e ejection opening, that is, smaller than the distance h1, for example, to about 20 (μm).

The cross sectional shape of each ejection opening 76*a*i of the ejection opening array 76A is composed of, for example, a small-diameter part 76 ns having a diameter of about 30 (μm) and a large-diameter part 76 ng. A size h2 in the axial direction of the small-diameter part 76 ns is set to 40 (μm), and a size h3 in the axial direction of the large-diameter part 76 ng is set to 10 (μm). The cross sectional shape of each ejection opening 76*b*i of the ejection opening array 76B is composed of, for example, a small-diameter part 76 nm having a diameter of about 14.5 (μm) and a large-diameter part 76 nw. A size h5 in the axial direction of the small-diameter part 76 nm is set to 25 (μm), and a size h6 in the axial direction of the large-diameter part 76 nw is set to 35 (μm).

Therefore, the ink ejection section of the print head unit is formed of the connection member 78, the orifice plate 76, the printing element substrate 60, and the base 62.

In assembling such an ink ejection section, assembly is performed similar to the above-described example. In this case, in the orifice plate 76, since the ejection opening array of relatively large in ejection amount requires more ink supply amount compared to ejection opening array of relatively small ejection amount, the height h1 of the branched flow passage which is to be equal in flow passage width to each other is machined to be larger compared to the height h4 of the branched flow passage.

In such a construction, the ink ejection section, when the paper Pa is in a stop state, in association with movement of the carriage member 32, ejects each ink droplet IDB and IDC of black or cyan at a predetermined timing to the recording surface of the paper Pa through the opening 28*a* of the enclosure 28 to perform printing operation.

Therefore, for ejection of black ink required to have relatively high throughput, a relatively large ejection amount can be obtained, and, for ejection of color ink such as cyan required to have high image quality, a relatively small ejection amount can be obtained. Here, for black ink ejection, an ejection method is used in which a bubble generated by heat generated by the electrothermal converter is defoamed, and for color ink ejection, an ejection method is used in which a bubble generated by heat generated by the electrothermal converter communicates with the atmosphere. As a result thereof, flow rates flowing into respective ejection opening arrays can be set according to ejection amounts of respective inks without reducing a so-called throughput.

Figure 6:
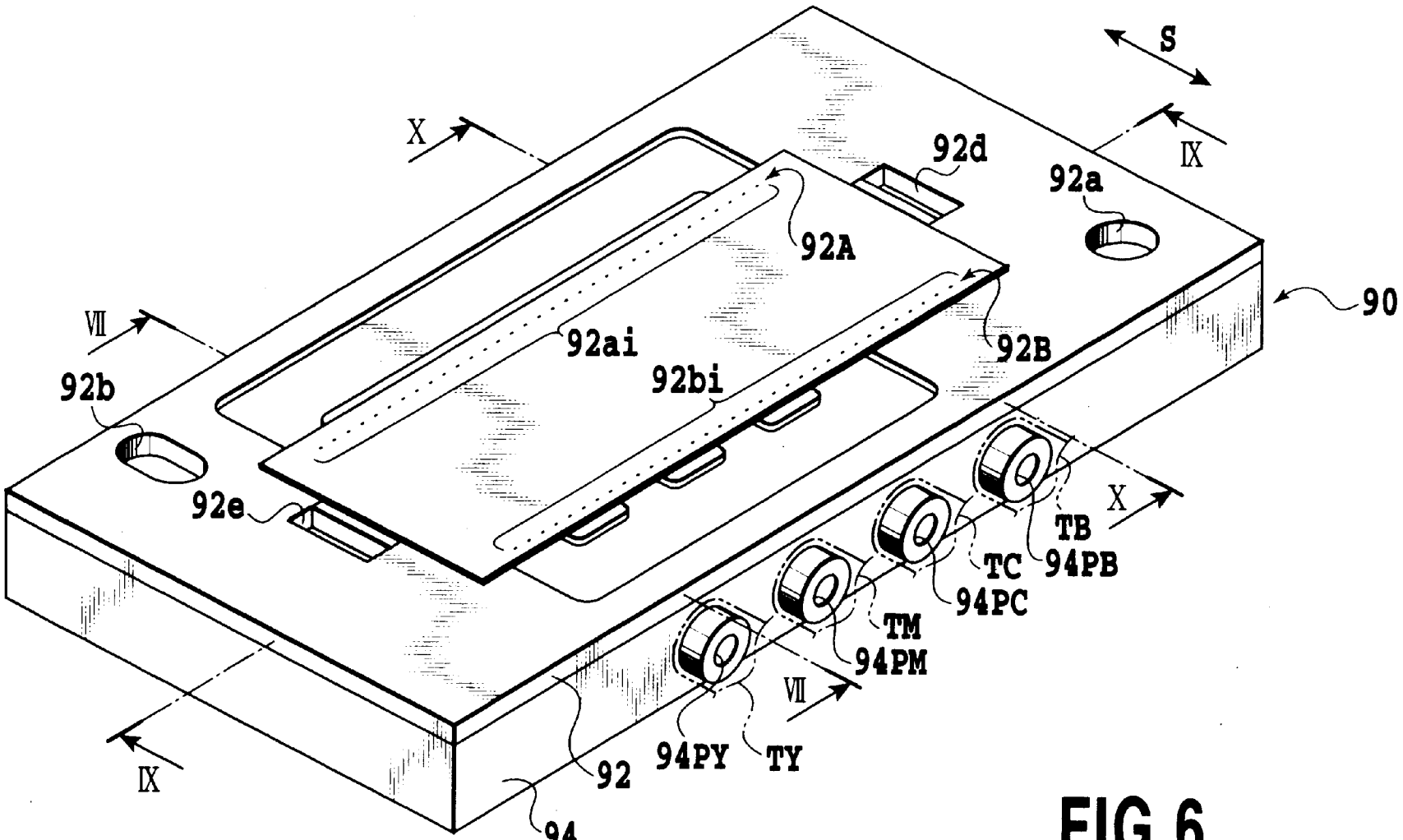
FIG. 6 is a perspective view showing an essential part of a third embodiment of the liquid ejection head according to the present invention.

FIG. 6 shows part of a third embodiment of the liquid ejection print head according to the present invention.

In the above-described example, it is constructed so that the ink tank and the ink ejection section are integrally formed, however, in the example shown in FIG. 6, the ink ejection section 90 is provided separately from the ink tank.

In FIG. 6, the ink ejection section 90 comprises an orifice plate 92 having ejection opening arrays 92A and 92B and a printing element substrate 94 on which respective heaters, which will be described later, are formed on the surface corresponding to the ejection opening arrays 92A and 92B of the orifice plate 92. Outer dimensions of the ink ejection section 90 are, for example, about 30×45×20 (mm).

Figure 7:
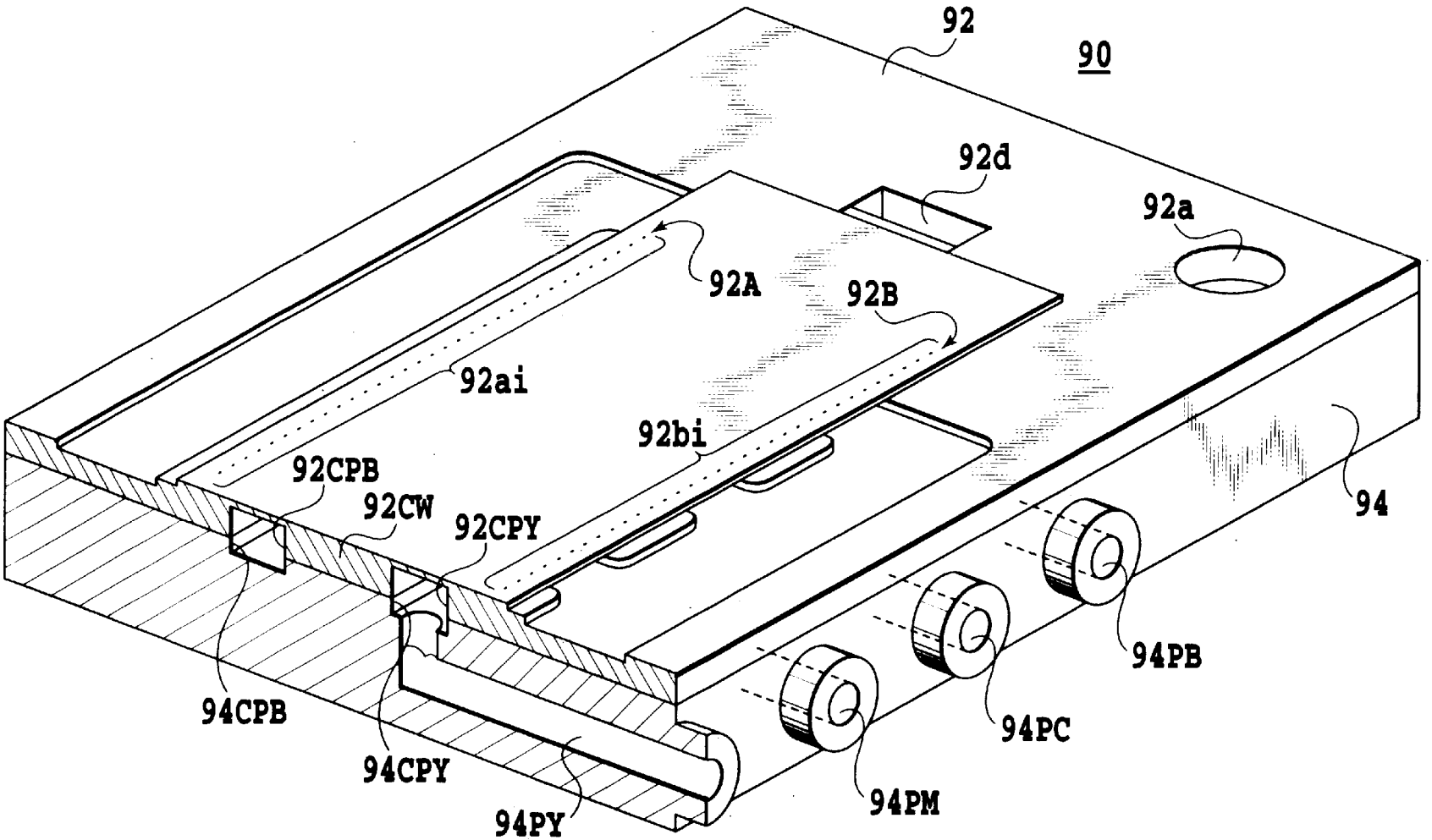
FIG. 7 is a perspective view including a partial cross sectional view shown along line VII—VII in FIG. 6.

The orifice plate 92, as shown in FIG. 7, is provided with the ejection opening arrays 92A and 92B parallel to each other formed in two rows at nearly central part. In the ejection opening arrays 92A and 92B, a plurality of ejection openings 92*a*i and 92*b*i (i=1 to n, n being an integer) are formed at a predetermined interval. Between the ejection opening arrays 92A and 92B is partitioned by a central partition wall 92CW protruding inside and extending along the arrangement direction of the ejection openings 92*a*i and 92*b*i.

At the ejection opening array 92A side in the central partition wall 92CW, a recess 92CPB supplied with black ink is formed which will be described later. Further, at the ejection opening array 92B side in the central partition wall 92CW, as shown in FIG. 8 and FIG. 9, recesses 92CPY, 92CPM, and 92CPC supplied respectively with yellow ink, magenta ink, and cyan ink are dividedly formed which will be described later.

Figure 8:
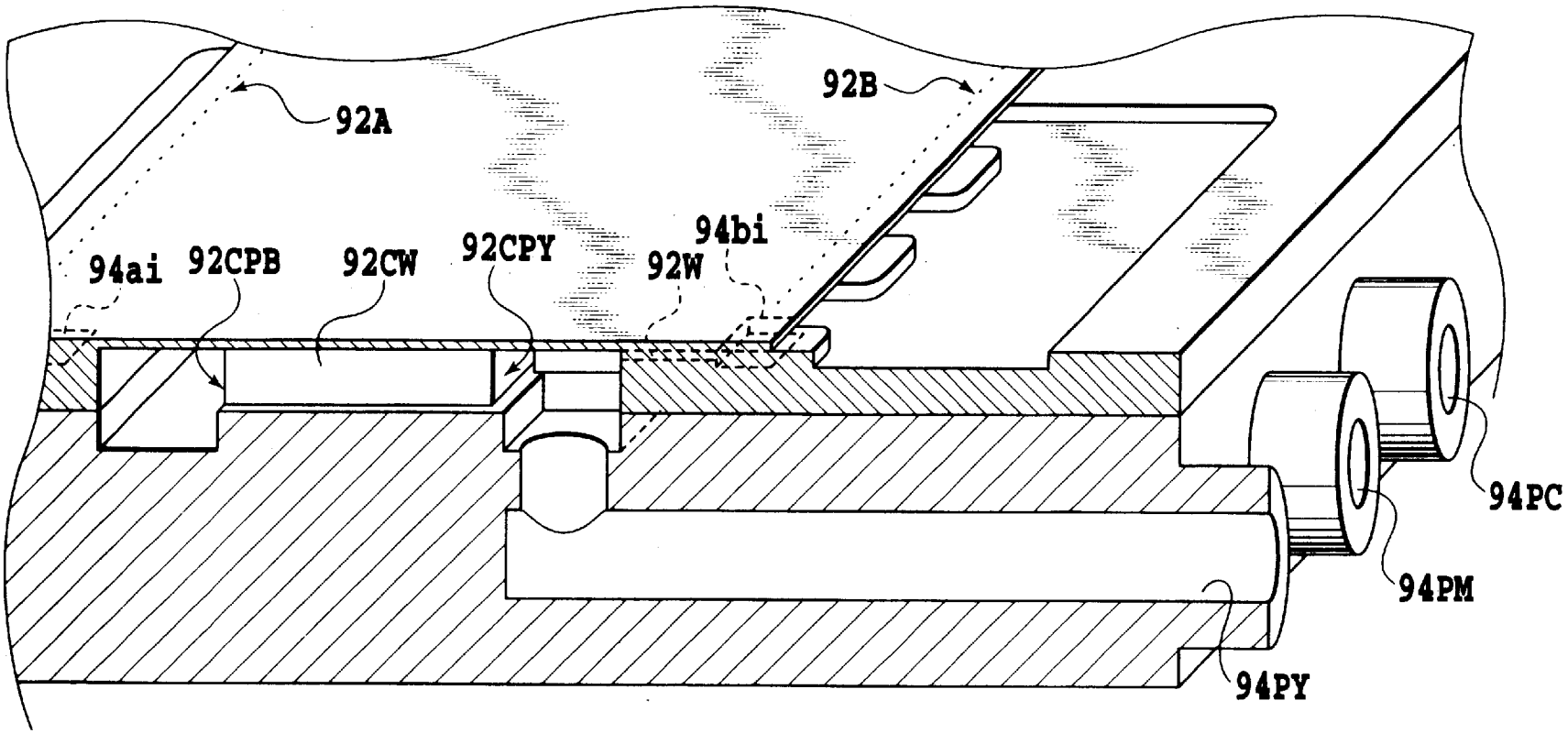
FIG. 8 is a partial enlarged view in the example shown in FIG. 7.
Figure 9:
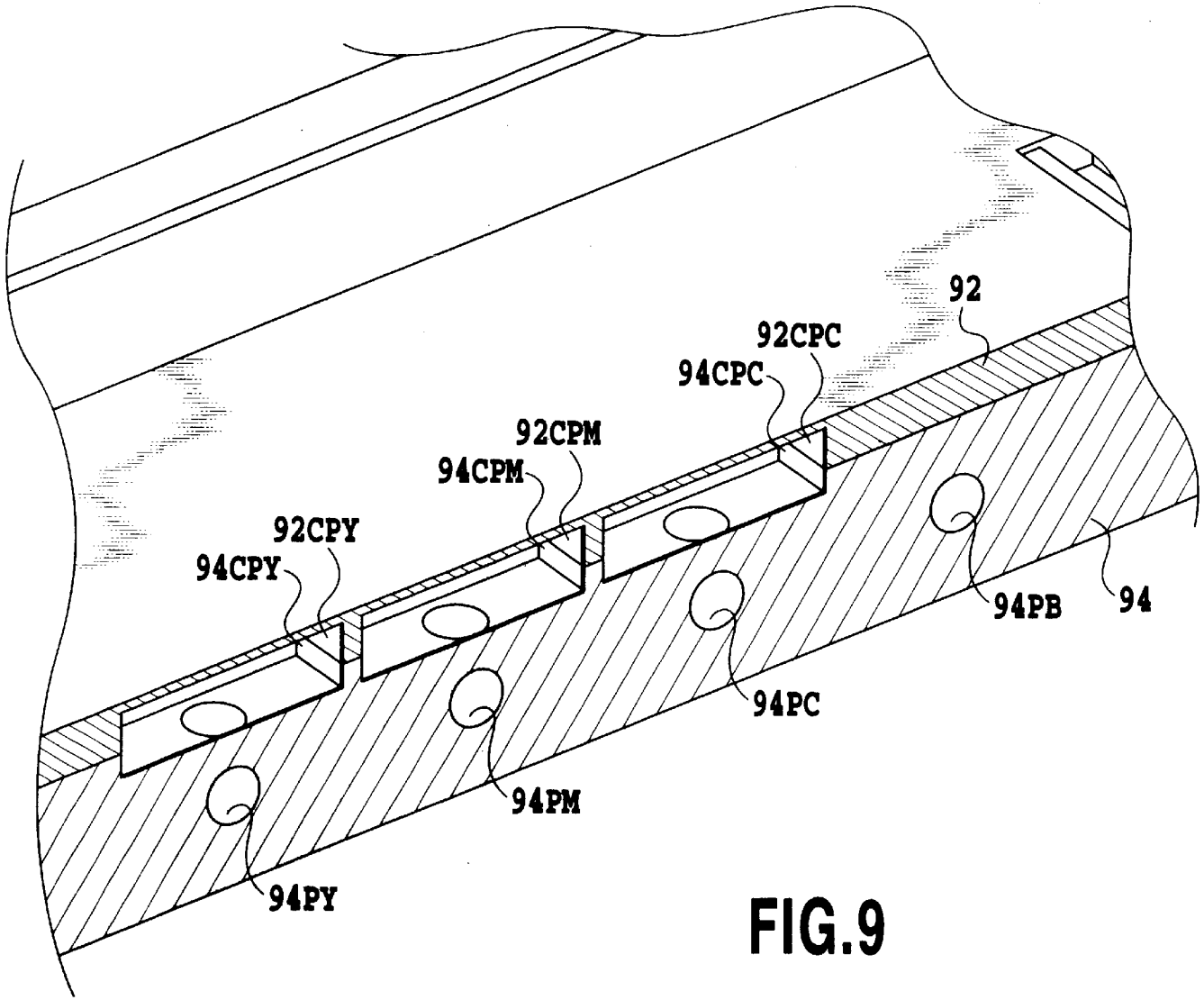
FIG. 9 is a perspective view including a partial cross sectional view shown along line IX—IX in FIG. 6.

Between adjacent ejection openings 92*a*i and between adjacent ejection openings 92*b*i, as shown in FIG. 8, is partitioned by a partition wall 92*w*. Therefore, the respective branched flow passages formed by a pair of partition walls 92*w* communicate with the recess 92CPB or the respective recesses 92CPY, 92CPM, and 92CPC.

At both ends by shorter side of the orifice plate 92, as shown in FIG. 6, recesses 92*a* and 92*b* for performing relative positioning to a support member (not shown) and injection openings 92*d* and 92*e* injected with a sealing adhesive are formed.

At one end of respective ink supply passages opening at one side of the printing element substrate 94, one ends of tubes TY, TM, TC and TB for supplying respective inks are connected. For example, the other ends of tubes TY, TM, TC and TB of inner diameter of 1.5 mm are connected to the ink tank unit (not shown) disposed with a predetermined height difference from the ink ejection section. In the ink tank unit, yellow ink, magenta ink, cyan ink and black ink are stored in an amount of 100 ml each in divided small chambers. The yellow ink, magenta ink, cyan ink and black ink are supplied to ink supply passages 94PY, 94PM, 94PC and 94PB through the ink supply tubes TY, TM, TC and TB.

Figure 10:
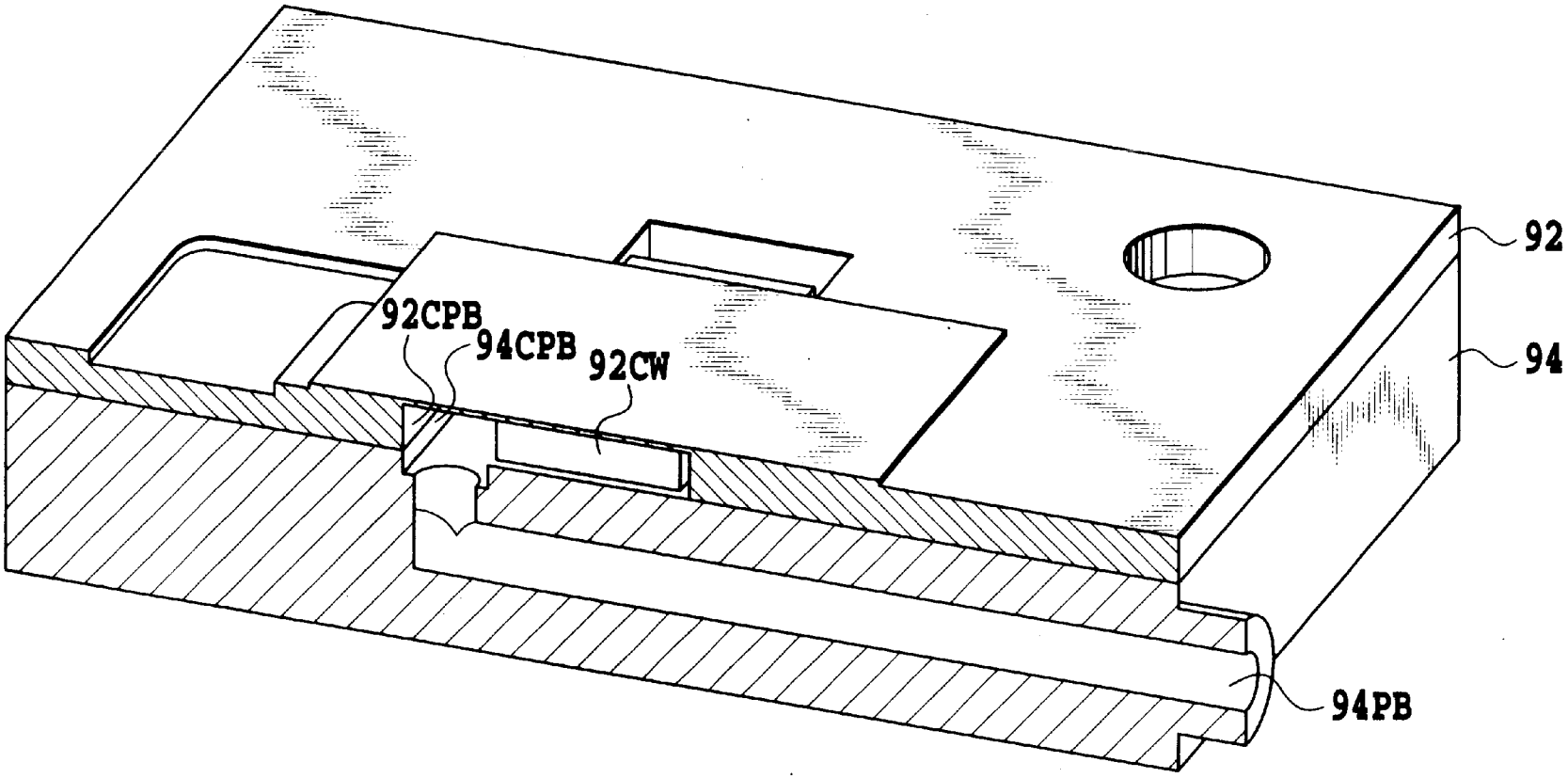
FIG. 10 is a perspective view including a partial cross sectional view shown along line X—X in FIG. 6.

The other ends of the ink supply passages 94PY, 94PM, 94PC and 94PB, as shown in FIG. 9 and FIG. 10, communicate with recesses 94CPY, 94CPM, 94CPC and 94CPB formed in opposition to the respective recesses 92CPY, 92CPM, 92CPC and 92 CPB of the orifice plate 92 in the printing element substrate 94. With this construction, yellow ink, magenta ink, cyan ink are supplied to the respective common liquid chambers formed integrally with the respective recesses 92CPY, 92CPM, and 92CPC and recesses 94CPY, 94CPM, and 94CPC. Further, as shown in FIG. 10, a common liquid chamber formed integrally with the recesses 92CPB and 94CPB is supplied with black ink. Therefore, the ejection opening array 92A is to eject only black ink, on the other hand, the ejection opening array 92B is to eject yellow ink, magenta ink and cyan ink in a predetermined ratio corresponding to the volumes of the recesses 94CPY, 94CPM, and 94CPC.

Further, in the part opposing the ejection opening arrays 92A and 92B of the orifice plate 92 in the printing element substrate 94, heaters 94*a*i and 94*b*i (i=1 to n, n being an integer) corresponding to the respective ejection openings and respective branched flow passages are formed. A distance (height of partition wall) from the surface where the heaters 94*a*i and 94*b*i in the respective branched flow passages are formed to the inner surface of the orifice plate 92 is to be equal to each other in the ejection opening arrays 92A and 92B.

With this construction, the ink ejection section of the print head unit, when the paper Pa is in a stop state, in association with movement of the carriage member 32, each ink droplet of yellow ink, magenta ink, cyan ink, and black ink is ejected through the opening 28*a* of the enclosure 28 at a predetermined timing to the recording surface of the paper Pa to perform printing operation.

Figure 11:
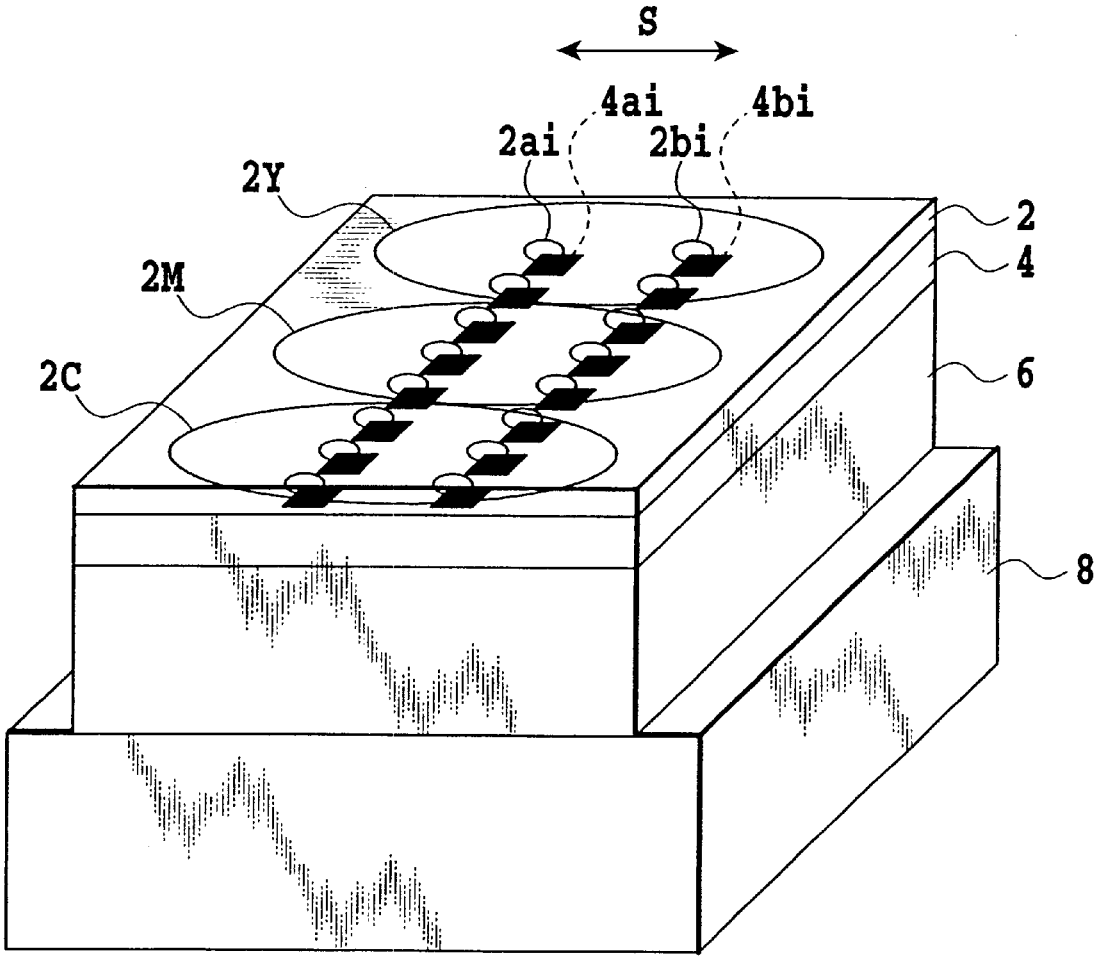
FIG.11 PRIOR ART
FIG. 11 is a perspective view showing schematically the construction of a prior art print head.
Figure 12:
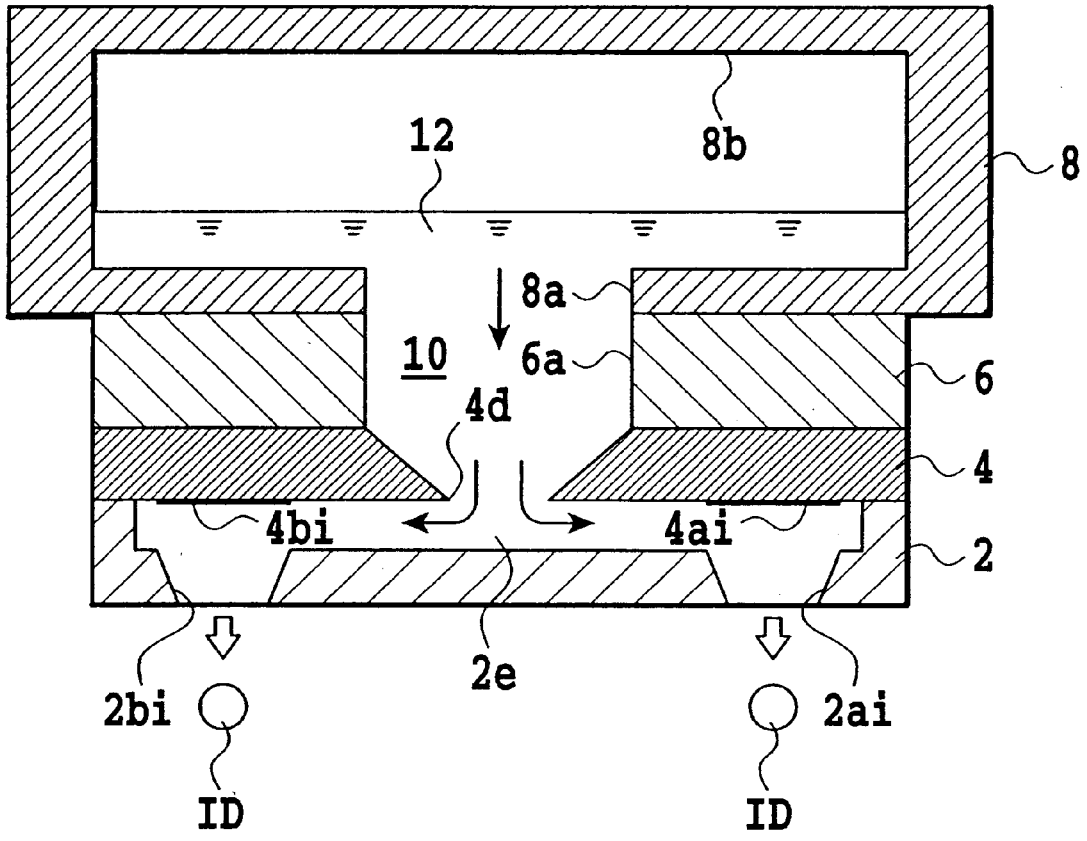
FIG.12 PRIOR ART
FIG. 12 is a cross sectional view in the example shown in FIG. 11.
Figure 13:
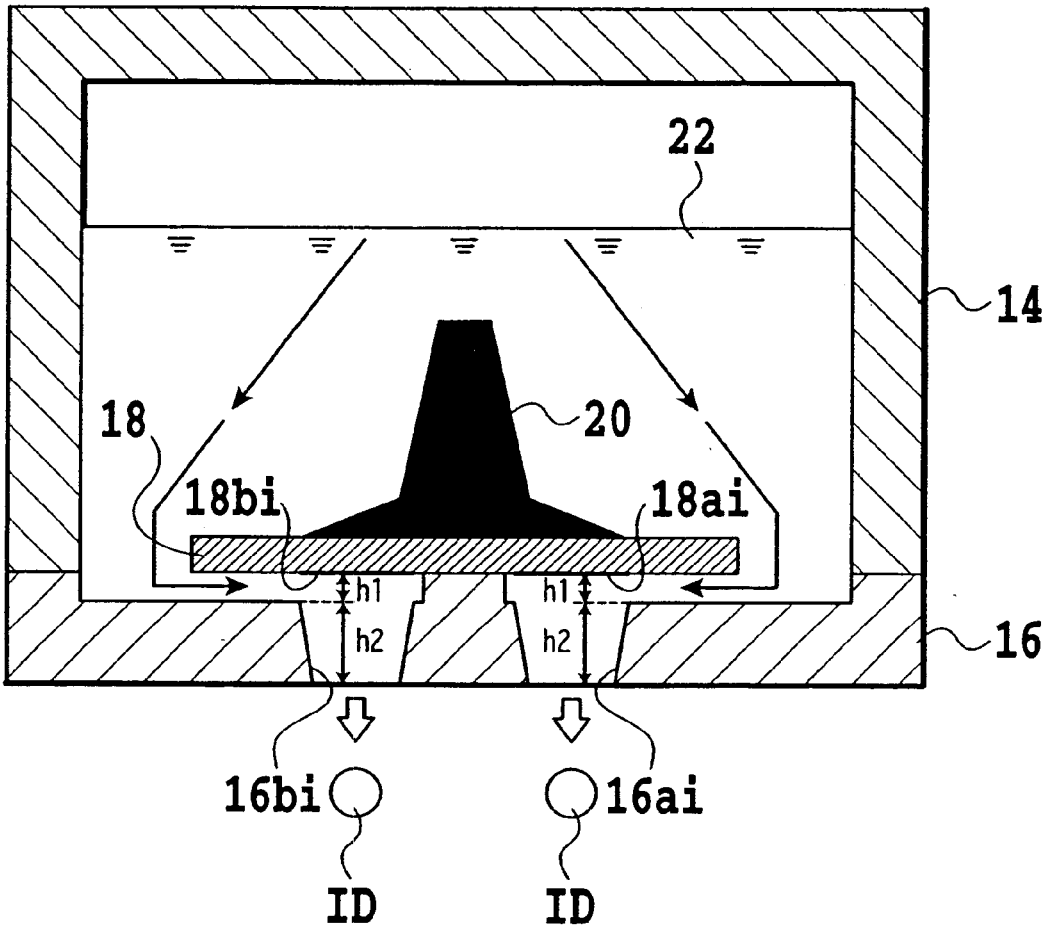
FIG.13 PRIOR ART
FIG. 13 is a cross sectional view showing schematically the construction of a prior art print head.

Therefore, when inks of a plurality of colors are ejected by a single ink ejection section 90 while moving along the direction shown by arrow S in FIG. 6, when a throughput is required to be maintained for black ink printing, since for black ink, printing width by a single scan is the maximum width corresponding to the arrangement length of the ejection opening, as shown in FIG. 11, a reduction in so-called throughput is prevented compared to the prior art case in which the ejection opening array is dividedly used for respective colors.

In the above-described example, inks of a plurality of different colors are used, however, the present invention is not limited to such an example, but inks of a plurality of shades differing in ink concentration may be used.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid ejection head comprising:

a liquid ejection opening formation section in which a first group of liquid ejection openings for ejecting a first liquid and a second group of liquid ejection openings for ejecting a second liquid are formed;

an element substrate having a plurality of energy generation elements formed corresponding to said first group of liquid ejection openings and said second group of liquid ejection openings for generating energy utilized to eject said first liquid from said first group of liquid ejection openings and to eject said second liquid from said second group of liquid ejection openings;

a first liquid supply passage formed between one end of said element substrate and an inner wall of said liquid ejection opening formation section for supplying the first liquid stored in a first liquid supply source to said energy generation elements corresponding to said first group of liquid ejection openings; and a second liquid supply passage formed independently of said first liquid supply passage between an other end of said element substrate at a side opposite said one end and said inner wall of said liquid ejection opening formation section for supplying the second liquid stored in a second liquid supply source independent of said first liquid supply source to said energy generation elements corresponding to said second group of liquid ejection openings, wherein a flow passage cross-sectional area of said first liquid supply passage and a flow passage cross-sectional area of said second liquid supply passage are different from each other.

2. The liquid ejection head as claimed in claim 1, wherein the first liquid stored in said first liquid supply source and the second liquid stored in said second liquid supply source are different in type from each other.

3. The liquid ejection head as claimed in claim 2, wherein a cross sectional area of each of said first branched liquid flow passages for conducting the first liquid to said first group of liquid ejection openings and a cross sectional area of each of said second branched liquid flow passages for conducting the second liquid to said second group of liquid ejection openings are different from each other.

4. The liquid ejection head as claimed in claim 2, wherein the first liquid and the second liquid are inks differing in ink color or concentration from each other.

5. The liquid ejection head as claimed in claim 1, wherein said first liquid supply passage comprises a first common liquid flow passage for conducting the first liquid from said first liquid supply source and first branched liquid flow passages for conducting the first liquid from said first common liquid flow passage to said first group of liquid ejection openings, and said second liquid supply passage comprises a second common liquid flow passage for conducting the second liquid from said second liquid supply source and second branched liquid flow passages for conducting the second liquid from said second common liquid flow passage to said second group of liquid ejection openings.

6. A liquid ejection apparatus comprising:

the liquid ejection head of claim 1;

moving means for moving said liquid ejection head in correspondence with a recording surface of a printing medium; and a controller for controlling printing operation of said liquid ejection head and operation of said moving means.

7. A head cartridge comprising the liquid ejection head of claim 1, wherein said first liquid supply source and said second liquid supply source are detachably mounted to said liquid ejection head.

8. A liquid ejection head comprising:

a liquid ejection opening formation section in which a first group of liquid ejection openings for ejecting a first liquid and a second group of liquid ejection openings for ejecting a second liquid are formed;

an element substrate having a plurality of energy generation elements formed corresponding to said first group of liquid ejection openings and said second group of liquid ejection openings for generating energy utilized to eject said first liquid from said first group of liquid ejection openings and to eject said second liquid from said second group of liquid ejection openings;

a first liquid supply passage formed between one end of said element substrate and an inner wall of said liquid ejection opening formation section for supplying the first liquid stored in a first liquid supply source to said energy generation element corresponding to said first group of liquid ejection openings; and a second liquid supply passage formed independently of said first liquid supply passage between an other end of said element substrate at a side opposite said one end and said inner wall of said liquid ejection opening formation section for supplying the second liquid stored in a second liquid supply source independent of said first liquid supply source to said energy generation elements corresponding to said second group of liquid ejection openings, wherein a cross-sectional area of each ejection opening of said first group of liquid ejection openings and a cross-sectional area of each ejection opening of said second group of liquid ejection openings are different from each other.

9. A liquid ejection head comprising:

a liquid ejection opening formation section in which a first group of liquid ejection openings for ejecting a first liquid and a second group of liquid ejection openings for ejecting a second liquid are formed;

an element substrate having a plurality of energy generation elements formed corresponding to said first group of liquid ejection openings and said second group of liquid ejection openings for generating energy utilized to eject said first liquid from said first group of liquid ejection openings and to eject said second liquid from said second group of liquid ejection openings;

a first liquid supply passage formed between one end of said element substrate and an inner wall of said liquid ejection opening formation section for supplying the first liquid stored in a first liquid supply source to said energy generation elements corresponding to said first group of liquid ejection openings; and a second liquid supply passage formed independently of said first liquid supply passage between an other end of said element substrate at a side opposite said one end and said inner wall of said liquid ejection opening formation section for supplying the second liquid stored in a second liquid supply source independent of said first liquid supply source to said energy generation elements corresponding to said second group of liquid ejection openings, wherein a distance between said inner wall of said liquid ejection opening formation section and any of said energy generation elements opposing one of said ejection openings of said first group of liquid ejection openings and a distance between said inner wall of said liquid ejection opening formation section and any of said energy generation elements opposing one of said ejection openings of said second group of liquid ejection openings are different from each other.

10. A liquid ejection head comprising:

a liquid ejection opening formation section in which a first group of liquid ejection openings and a second group of liquid ejection openings for ejecting a first liquid and a second liquid are formed;

a printing element substrate having printing elements formed corresponding to said first group of liquid ejection openings and said second group of liquid ejection openings of said liquid ejection opening formation section for ejecting the first liquid and the second liquid through said first group of liquid ejection openings and said second group of liquid ejection openings;

a first liquid supply passage formed inside said printing element substrate for supplying the first liquid from a first liquid supply source to said printing elements corresponding to said first group of liquid ejection openings in said printing element substrate; and a liquid supply passage group comprising a plurality of second liquid supply passages formed inside said printing element substrate independent of said first liquid supply passage for individually supplying the second liquid from a plurality of second liquid supply sources to printing elements corresponding to said second group of liquid ejection openings in said printing element substrate.

11. The liquid ejection head as claimed in claim 10, wherein the first liquid and the second liquid are ink.

12. The liquid ejection head as claimed in claim 10, wherein said liquid ejection opening formation section is formed of a resin material and said first group of liquid ejection openings and said second group of liquid ejection openings are formed by laser machining.

13. The liquid ejection head as claimed in claim 10, wherein said printing elements of said printing element substrate are electrothermal converters.

14. The liquid ejection head as claimed in claim 10, wherein a flow passage cross sectional area of said first liquid supply passage and a flow passage cross sectional area of said liquid supply passage group differ from each other in accordance with ejection amounts of said first group of liquid ejection openings and said second group of liquid ejection openings, respectively.

15. A liquid ejection apparatus comprising:

the liquid ejection head of claim 10;

moving means for moving said liquid ejection head in correspondence with a recording surface of a printing medium; and a controller for controlling printing operation of said liquid ejection head and operation of said moving means.

* * * * *

UNITED STATES PATENT AND TRADEMARK OFFICE

CERTIFICATE OF CORRECTION

PATENT NO. : 6,508,538 B2
DATED : January 21, 2003
INVENTOR(S) : Toru Suzuki et al.

It is certified that error appears in the above-identified patent and that said Letters Patent is hereby corrected as shown below:

Column 1,
Line 60, "be" should read -- become --; and
Line 65, "that" should read -- in which --.

Column 3,
Lines 44, 46 and 62, "ejection." should read -- ejection --; and "cross sectional" should read -- cross-sectional --.

Column 4,
Line 4, "ejection." should read -- ejection --; and "cross sectional" should read -- cross-sectional --;
Lines 9, 14 and 16, "cross" should read -- cross- --;
Lines 20 and 22, "cross sectional" should read -- cross-sectional --;
Line 21, "FIG. 11;" should read -- FIG. 11; and --; and
Line 36, "in" should be deleted.

Column 5,
Line 17, "magenta-ink" should read -- magenta ink --;
Line 37, "in" should be deleted --;
Line 42, "each other" should read -- mutually --;
Line 51, "aspolysulfone," should read -- as polysulfone, --; and
Line 52, "(trade mark)" should read -- (trademark) --.

Column 6,
Line 15, "distance" should read -- distance, --; and
Line 67, "cross" should read --cross- --.

Column 7,
Line 5, "part" should read -- parts --;
Line 8, "the." should read -- the --;
Line 12, "cross sectional" should read -- cross-sectional --;
Line 16, "cross sec-" should read -- cross-sec- --;
Line 34, "in" should be deleted; and
Line 44, "each other" should read -- mutually --.

Column 8,
Line 9, "on e" should read -- one --; and
Lines 11 and 17, "cross sectional" should read -- cross-sectional --.

UNITED STATES PATENT AND TRADEMARK OFFICE

CERTIFICATE OF CORRECTION

PATENT NO. : 6,508,538 B2
DATED : January 21, 2003
INVENTOR(S) : Toru Suzuki et al.

It is certified that error appears in the above-identified patent and that said Letters Patent is hereby corrected as shown below:

Column 9,
Line 34, "ends" should read -- end --.

Column 10,
Line 56, "an other" should read -- another --.

Column 11,
Lines 6 and 8, "cross sectional" should read -- cross-sectional --; and
Line 60, "an other" should read -- another --.

Column 12,
Line 24, "an other" should read -- another --.

Column 13,
Lines 12 and 13, "cross sectional" should read -- cross-sectional --.

Signed and Sealed this

Ninth Day of March, 2004

JON W. DUDAS
*Acting Director of the United States Patent and Trademark Office*